US009322158B1

(12) United States Patent
Langmeier et al.

(10) Patent No.: US 9,322,158 B1
(45) Date of Patent: Apr. 26, 2016

(54) LAMINATED COLUMN WITH SPACER

(71) Applicant: Thomas Gerard Langmeier, Bloomington, WI (US)

(72) Inventors: Thomas Gerard Langmeier, Bloomington, WI (US); David Gary Dahlin, Green Bay, WI (US)

(73) Assignee: Thomas Gerard Langmeier, Bloomington, WI (US)

( * ) Notice: Subject to any disclaimer, the term of this patent is extended or adjusted under 35 U.S.C. 154(b) by 0 days.

(21) Appl. No.: 14/661,597

(22) Filed: Mar. 18, 2015

(51) Int. Cl.

| | |
|---|---|
| ***E04B 1/26*** | (2006.01) |
| ***E04C 3/36*** | (2006.01) |
| ***E04B 1/19*** | (2006.01) |
| ***E04B 7/02*** | (2006.01) |
| ***E04C 3/42*** | (2006.01) |
| ***E04C 3/38*** | (2006.01) |

(52) U.S. Cl.
CPC ... *E04B 1/26* (2013.01); *E04B 1/19* (2013.01); *E04B 7/02* (2013.01); *E04C 3/36* (2013.01); *E04C 3/38* (2013.01); *E04C 3/42* (2013.01); *E04B 2103/04* (2013.01)

(58) Field of Classification Search
CPC ..... E04B 1/26; E04B 1/19; E04B 7/02; E04C 3/30; E04C 3/38; E04C 3/42
See application file for complete search history.

(56) References Cited

U.S. PATENT DOCUMENTS

| | | | | | |
|---|---|---|---|---|---|
| 1,673,788 | A | * | 6/1928 | Hobson | 52/92.3 |
| 2,688,167 | A | * | 9/1954 | Wilson | 403/402 |
| 3,072,313 | A | * | 1/1963 | Svendsen | 206/586 |
| 4,285,176 | A | * | 8/1981 | Runkle | 52/93.1 |
| 4,387,546 | A | * | 6/1983 | Kurita et al. | 52/847 |
| 4,441,287 | A | * | 4/1984 | Muir | 52/93.2 |
| 4,479,342 | A | | 10/1984 | Eberle | |
| 4,568,577 | A | * | 2/1986 | Fischetti | 428/33 |
| 2002/0026767 | A1 | * | 3/2002 | Dowland | 52/741.13 |
| 2005/0066615 | A1 | * | 3/2005 | Wilhour | 52/720.1 |
| 2005/0170166 | A1 | * | 8/2005 | Bacon et al. | 428/301.4 |
| 2013/0022814 | A1 | * | 1/2013 | Lin | 428/397 |

* cited by examiner

*Primary Examiner* — Adriana Figueroa
*Assistant Examiner* — Jessie Fonseca
(74) *Attorney, Agent, or Firm* — Fredrikson & Byron, P.A.

(57) ABSTRACT

A method of manufacturing a column for a post frame building. The method including providing a plurality of elongate members arranged side by side. Each elongate member having first and second ends, and first, second, third and fourth faces. The plurality of elongate members may include a first side member, one or more center members, and a second side member. The method further including providing a spacer formed by a first spacer portion, a second spacer portion and a third spacer portion, the second spacer portion being at about a 90 degree angle to the first and third spacer portions. Inserting the first spacer portion between the second face of the first side member and the first face of one of the one or more center members. Inserting the third spacer portion between the second face of the one of the one or more center members and the first face of the second side member, and joining the first side member, the one or more center members, the second side member and the spacer together.

20 Claims, 9 Drawing Sheets

Fig. 3a
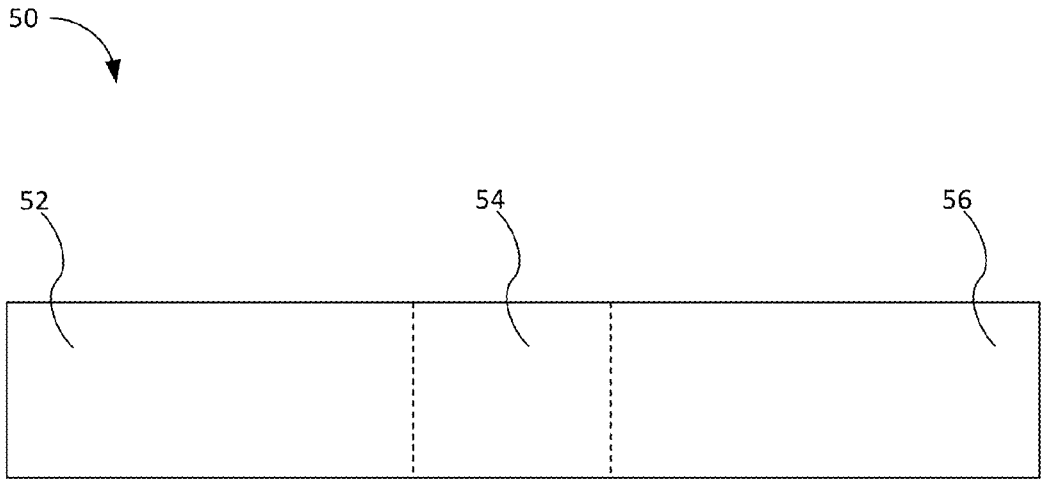
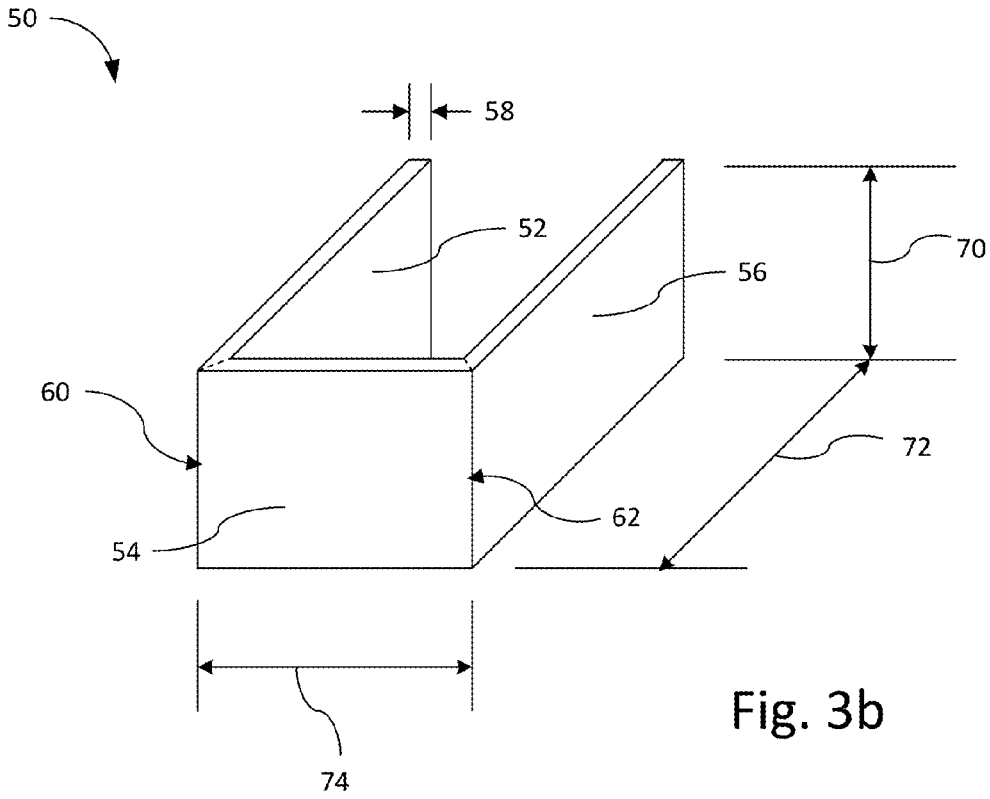
Fig. 3b

LAMINATED COLUMN WITH SPACER

TECHNICAL FIELD

This disclosure relates in general to post frame buildings, and more particularly to a method of manufacturing columns for post frame buildings.

BACKGROUND

Post frame buildings, which evolved from pole barns, are used for a wide variety of commercial, industrial and agricultural purposes. Compared to other types of construction, post frame buildings are relatively easy and inexpensive to erect. A typical post frame building has a series of columns (e.g., wooden posts) that are set into the earth along its perimeter. The columns are coupled to one another by horizontal members (e.g., girts), and an exterior siding is fastened to the horizontal members. The columns also provide support for roof trusses.

SUMMARY

In general, this disclosure is directed to post frame buildings, and more particularly to laminated column constructions and a method of manufacturing laminated columns. The laminated columns of this disclosure may be configured to support a compressive load along a length axis. The load may be the load induced by a roof truss that the column is supporting.

In an illustrative embodiment, the disclosure provides a method of manufacturing a column for a post frame building. The method includes providing lumber, the lumber comprising a plurality of elongate members that are substantially rectangular cuboid shaped, arranged side-by-side. The elongate members may be similar to each other overall. For example, each elongate member may include a first end opposite a second end, the distance between the first and second ends defining a length of each elongate member. Each elongate member may also include a first face opposite a second face, the distance between the first and second faces defining a width of each elongate member, and a third face opposite a fourth face, the distance between the third and fourth faces defining a depth of each elongate member. The plurality of elongate members may include a first side member, one or more center members, and a second side member. In addition to the plurality of elongate members, a spacer and a fastening element may be provided. The spacer may be formed by a first spacer portion, a second spacer portion and a third spacer portion, the second spacer portion connecting the first spacer portion and the third spacer portion.

In addition to providing the first and second side members, the one or more center members, the spacer and the fastening element, steps of the illustrative embodiment of the method further include: arranging the second face of the first side member adjacent the first face of one of the one or more center members, and arranging the first face of the second side member adjacent the second face of one of the one or more center members; inserting the first spacer portion between the second face of the first side member and the first face of one of the one or more center members; inserting the third spacer portion between the second face of the one of the one or more center members and the first face of the second side member; and joining the first side member, the one or more center members, and the second member together with the fastening element.

In another illustrative embodiment of a method of manufacturing a column for a post frame building, the method includes providing lumber, the lumber including a plurality of elongate members that are substantially rectangular cuboid shaped. Each elongate member including a first end opposite a second end, the distance between the first and second ends defining a length of each elongate member, a first face opposite a second face, the distance between the first and second faces defining a width of each elongate member, and a third face opposite a fourth face, the distance between the third and fourth faces defining a depth of each elongate member. The plurality of elongate members may include a first side member, one or more center members, and a second side member. In addition to the plurality of elongate members, a spacer and a fastening element are provided. The spacer formed by a first spacer portion, a second spacer portion and a third spacer portion. The second spacer portion may connect the first spacer portion and the third spacer portion, the first and third spacer portions being generally parallel, the second spacer portion being at about a 90 degree angle to the first and third spacer portions. In addition to providing the first and second side members, the one or more center members, the spacer and the fastening element, steps of the second illustrative embodiment of the method further include: arranging the second face of the first side member adjacent the first face of one of the one or more center members, and arranging the first face of the second side member adjacent the second face of one of the one or more center members; inserting the first spacer portion between the second face of the first side member and the first face of one of the one or more center members, inserting the third spacer portion between the second face of one of the one or more center members and the first face of the second side member; placing the second spacer portion substantially parallel to the third face of one of the one or more center members; providing a fastening element; and joining the first side member, the one or more center members, the second side member and the spacer together with the fastening element.

In an illustrative embodiment of a laminated column for constructing a post frame building, the column may include a spacer having two spacer portions (a first and second spacer portion), a fastening element, and a plurality of elongate members. The elongate members may be formed of substantially rectangular cuboid shaped lumber, arranged side-by-side. Each elongate member may include: a first end opposite a second end, the distance between the first and second ends defining a length of each elongate member; a first face opposite a second face, the distance between the first and second faces defining a width of each elongate member; and a third face opposite a fourth face, the distance between the third and fourth faces defining a depth of each elongate member. The plurality of elongate members may include a first side member, one or more center members, and a second side member. The length of the one or more center members being in a range between 3 inches to 6 feet shorter than the first and second side members. In some embodiments, the range may be between 1 to 3 feet shorter, and in some embodiments it may be preferable for the length of the one or more center members to be about 2 feet shorter than the first and second side members. Such dimensions may accommodate a significant number of post frame building constructions arrangements.

As assembled, the first spacer portion is sandwiched between the second face of the first side member and the first face of one of the one or more center members, and the third spacer portion is sandwiched between a second face of one of the one or more center members and the first face of the second side member. The plurality of elongate members and the spacer are fixedly joined by the fastening element.

The present disclosure resolves problems with laminated column constructions. The present disclosure provides for easier assembly of the roof truss into the column. In particular, the roof truss width can be wider than the spacing between the side members provided by the center member(s). Even when the center member and the roof truss are of similar width (e.g., both 2×4's, 2×6's, 2×8's, 2×10'×, 2×12's, etc.). This difference in width may be because the portion of the roof truss inserted between the side members sometimes includes a gusset. The gusset adding an additional thickness to the roof truss.

The details of one or more examples are set forth in the accompanying drawings and the description below. Other features, objects, and advantages will be apparent from the description and drawings, and from the claims.

BRIEF DESCRIPTION OF DRAWINGS

FIG. 3*a* is a side view of a spacer in an unfolded configuration.

FIG. 3*b* is a perspective view of the spacer of FIG. 3*a* in a folded configuration.

DETAILED DESCRIPTION

The following detailed description is exemplary in nature and is not intended to limit the scope, applicability or configuration of the disclosure in any way. Rather, the following description provides practical illustrations for implementing illustrative embodiments of the disclosure.

Figure 1:
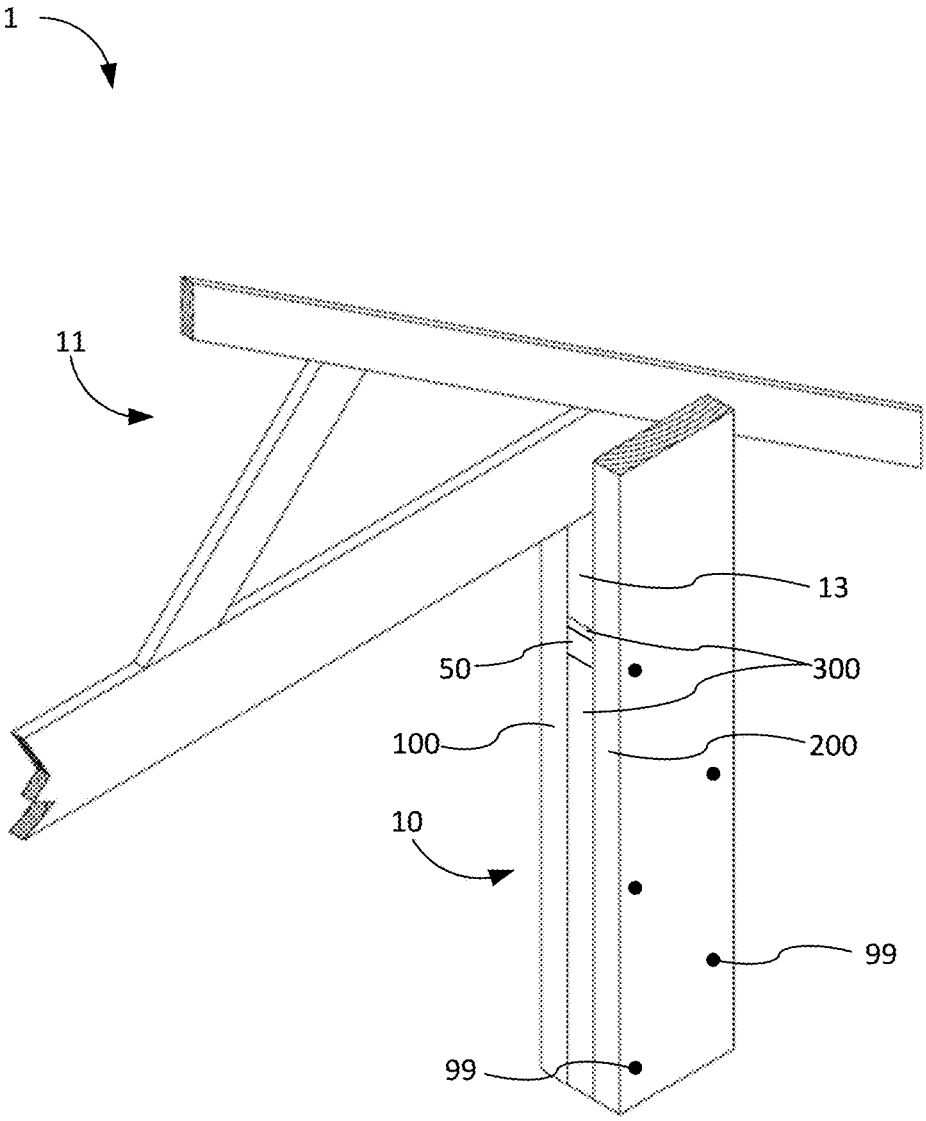
FIG. 1 is a perspective view of a roof truss and an illustrative embodiment of a column for constructing a post frame building.

The disclosure provides an advantageous laminated column and a method of manufacturing the column for use in a post frame building construction 1. In general, the column of the present disclosure is directed to supporting a roof truss as part of the support structure in a post frame building. The columns of the present disclosure may be provided as laminated members, and may be constructed as shown with respect to FIGS. 1-2 and 4-8. Generally, columns of the present disclosure are manufactured from three or more 2×4's, 2×6's, 2×8's, 2×10's or 2×12's, arranged side-by-side and joined together. For example, a laminated column 10 as shown in FIG. 1, may generally include two side members 100, 200 of the same length, and a shorter center member in between 300. The two side members creating a slot 92 (FIG. 4) at the upper end of the column 10 for receiving the roof truss 11. The lower end of the column 10 is placed into a hole bored into the ground in which a precast concrete pad or concrete mixture has been provided. At the upper end of the column 10, the side members 100, 200 extend above the center member 300. The benefit of this arrangement is that a roof truss 11 may be inserted between the two side members 100, 200 and rest on the center member 300.

Figure 2:
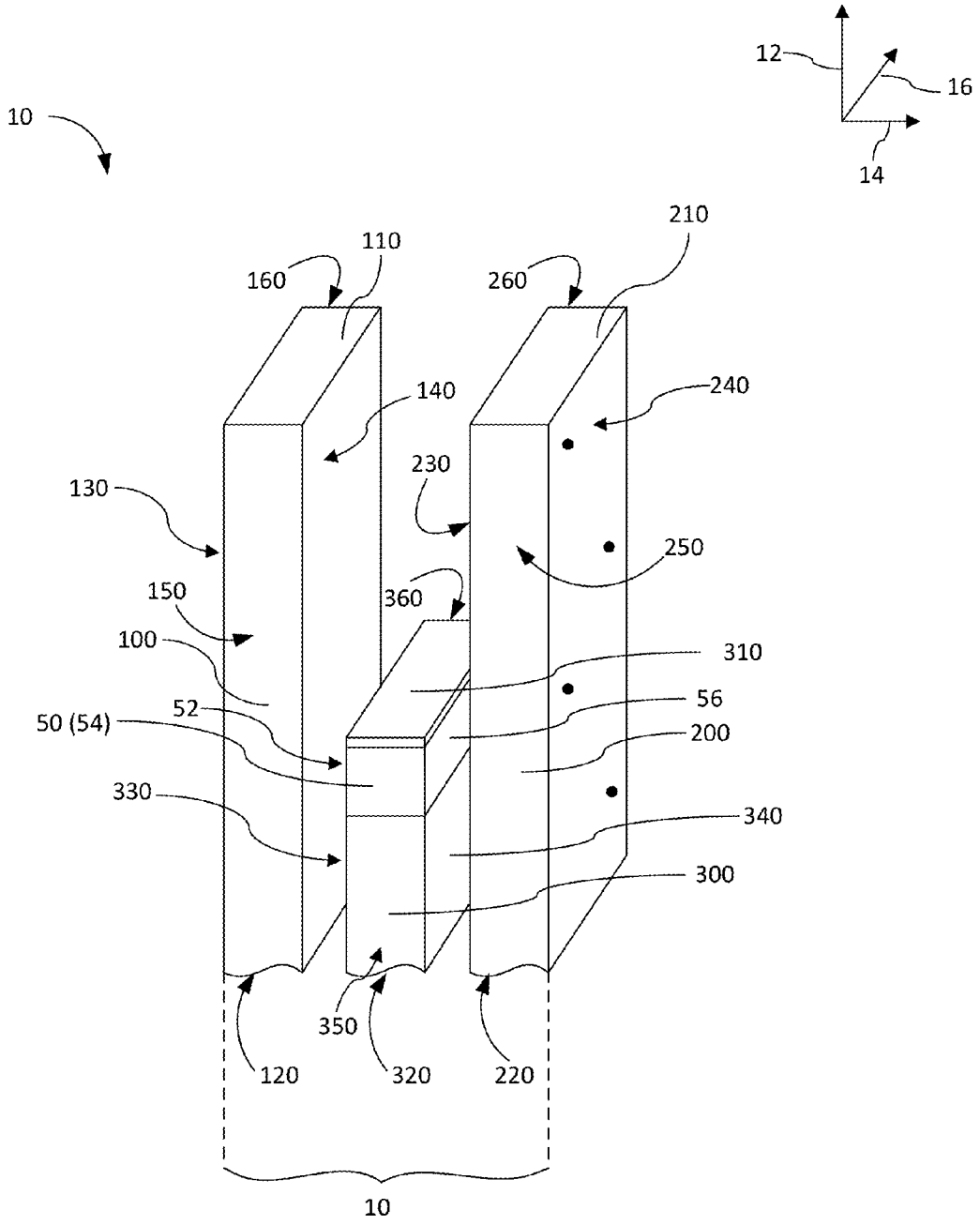
FIG. 2 is a perspective, partially exploded view illustrating a plurality of members and a spacer that form the column of FIG. 1.
Figure 4:
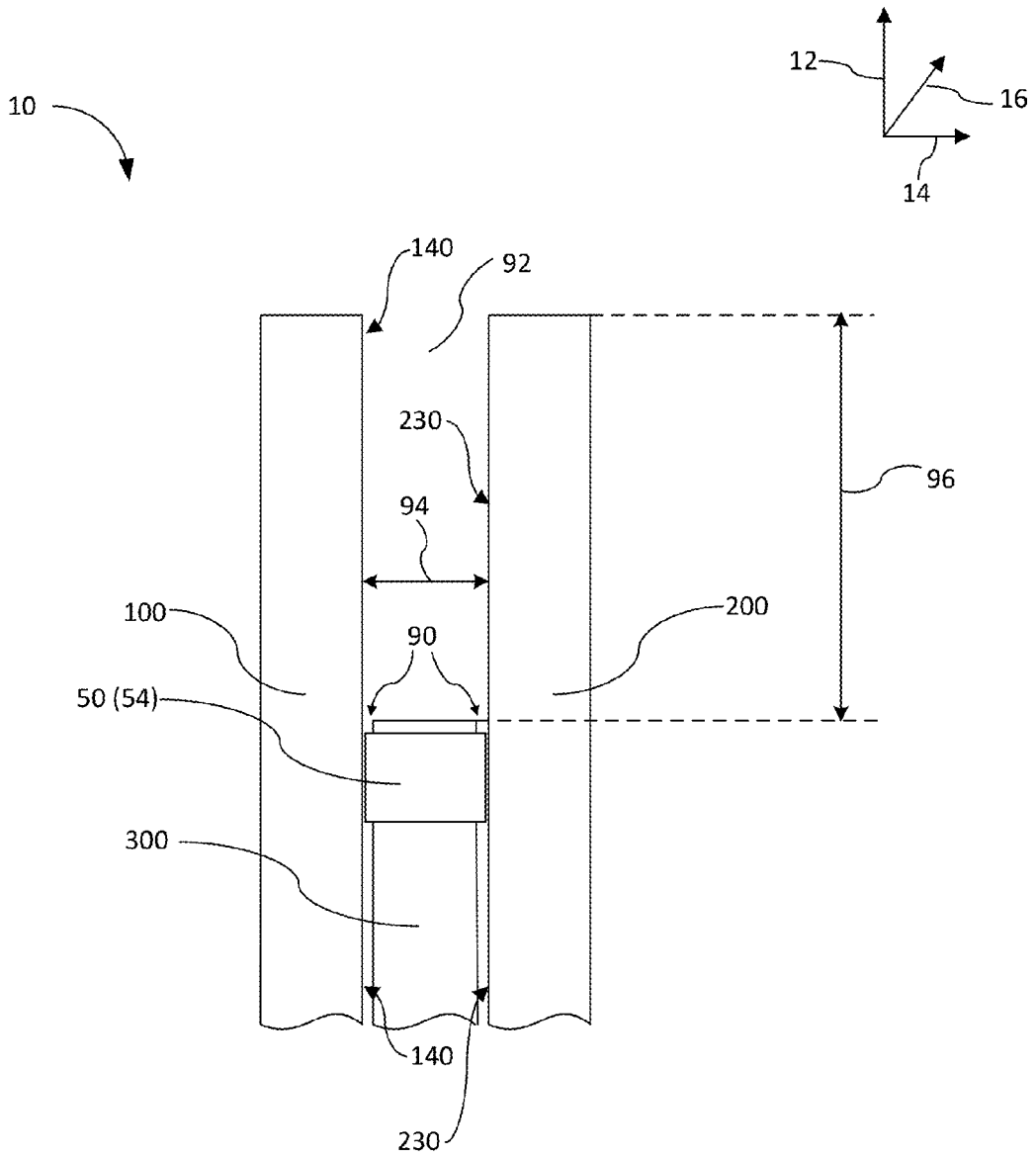
FIG. 4 is a side view of the column of FIG. 1.

As shown in FIGS. 1, 2 and 4, the column 10 may be adapted to provide a bearing surface to support the roof truss 11. The column 10 may capture a portion of the roof truss 11 and restrict movement of the roof truss 11. In addition, assembly of the roof truss 11 into the column 10 may be done without having to pry the slot 92 (FIG. 4) of the column 10 open in order to insert roof truss 11. Also shown in FIG. 1 is a spacer block 13 which may be a separate component, not necessarily integral to the column 10 or the roof truss 11.

The column 10 of FIG. 1 is shown in a partially exploded view in FIG. 2, and in an assembled view in FIG. 4. Column 10 includes the plurality of elongate members 100, 200, 300 and at least one spacer 50. The plurality of elongate members may include the first side member 100, the second side member 200, and one or more center members 300, arranged side-by-side as shown. The plurality of elongate members 100, 200, 300 may be formed of lumber, such as wood lumber that is substantially rectangular cuboid shaped. In some embodiments suitable wood lumber may include, but is not limited to, 2×4, 2×6, 2×8, 2×10, 2×12, 1×4, 1×6, 1×8, 1×10, or 1×12 lumber. In other embodiments a maintenance-free lumber substitute, such as plastic or composites may be used.

In the embodiment of FIGS. 1-4, the plurality of elongate members 100, 200, 300 may include a first side member 100, a second side member 200 and a center member 300. Each of the plurality of elongate members 100, 200, 300 has a first end 110, 210, 310 opposite a second end 120, 220, 320. The distance between the first end 110, 210, 310 and the second end 120, 220, 320 defining a length of each of the respective elongate members 100, 200, 300 along a length axis 12. Each of the plurality of elongate members 100, 200, 300 also has a first face 130, 230, 330 opposite a second face 140, 240, 340. The distance between the first face 130, 230, 330 and the respective second face 140, 240, 340 defining a width of each of the elongate members 100, 200, 300 along a width axis 14. In addition, each of the plurality of elongate members 100, 200, 300 has a third face 150, 250, 350 opposite a fourth face 160, 260, 360, the distance between the third faces 150, 250, 350 and respective fourth faces 160, 260, 360 defining a depth of each of the elongate members 100, 200, 300 along a depth axis 16.

The plurality of elongate members 100, 200, 300 are sized and arranged to form a slot 92 at first ends 110, 210, 310 of the plurality of elongate members 100, 200, 300. For example, the center member 300 may be shorter than the first and second side members 100, 200 along a length axis 12. The center member 300 may be sandwiched between the first and second side members 100, 200. This creates a slot 92 between the first side member 100 and the second side member 200. For example, the center member 300 may be shorter by 5 inches or more, resulting in a slot length 96 along the length axis 12 of about 5 inches or more. In some embodiments, to allow for ample adjustment on the job site, a center member 300 that is at least 2 feet shorter, or at most 6 feet shorter than the first and second side members 100, 200 may be provided. This allows a spacer block 13 to be custom made (e.g., cut) on the job site and inserted into the slot 92 to adjust the location of the roof truss 11 with respect to the column 10 when assembled. Therefore, in some embodiments, the length of the one or more center members 200 may be in a range between 3 inches to 6 feet shorter than the first and second side members 100, 200. In some embodiments, the range may be between 1 to 3 feet shorter, and in some embodiments it may be preferable for the length of the one or more center members 300 to be about 2 feet shorter than the first and second side members 100, 200. Such dimensions may accommodate a significant number of post frame building constructions arrangements.

In some embodiments, as will be discussed in further detail below, the plurality of elongate members 100, 200, 300 may include one or more center members 300. In some embodiments there could optionally be more than one first side members 100, and/or more than one second side members 200.

FIGS. 3*a*-3*b* show an embodiment of a spacer 50 that may be used in the exemplary column 10 of FIG. 1. FIG. 3*a* shows a side view of the spacer 50 in an unfolded configuration. FIG. 3*b* shows a perspective view of the spacer 50 in a folded configuration. The spacer 50 may include a first spacer portion 52, a second spacer portion 54, and a third spacer portion 56. The second spacer portion 54 may be intermediate (e.g., in between) the first spacer portion 52 and the second spacer portion 54, and may connect the first spacer portion 52 and the third spacer portion 56. The first spacer portion 52 may be joined to the second spacer portion 54 at a first hinge location 60. The third spacer portion 56 may be joined to the second spacer portion 54 at a second hinge location 62. First and second hinge locations 60, 62 may be flexible regions of the spacer 50, living hinges, fold lines, or any other suitable feature. The spacer 50 may be formed or bent at the first and second hinge locations 60, 62 such that spacer 50 is angled in these two locations. In some embodiments the angles are approximately 90 degree angles.

As shown in FIG. 3*b*, the spacer 50 dimensions may include a spacer height 70, a spacer depth 72, and a spacer width 74. The overall length of the spacer 50 being the sum of two times the spacer depth 72, plus 1 times the spacer width 74. In some embodiments the spacer depth and width are based on the lumber dimensions. For example, if the spacer 50 is to be used with a center member 300 formed of a wood 2×6 (actual dimensions about 1.5"×5.25"), the spacer width 74 may be about 1.5" or slightly larger (e.g., 1.5"-2.0"), while the spacer depth 72 may be about 5.25" or a slightly larger (5.25" to 5.75"). The thickness of the spacer 50 (spacer thickness 58) may range between about 0.020 inches to about 0.100 inches. The spacer thickness 58 may be determined based on the particular application, such as the dimensions of the roof truss 11, including any gussets, with which the column 10 will be used. In some embodiments including more than one center member 300, a thicker spacer 50 may be used, such as a double-thick spacer. For example, in such an embodiment, the spacer thickness 58 may range between about 0.040 inches to about 0.200 inches. Other ranges, such as those previously disclosed, or a range of about 0.020 inches to about 0.200 inches, are also possible. The thickness may also span outside of these ranges, or within a smaller range, depending on the application. The ranges disclosed may be used with any suitable embodiment.

A first embodiment for the arrangement of the plurality of elongate members 100, 200, 300 and the spacer 50 will now be described in further detail with respect to FIGS. 1-4. Various other embodiments with different arrangements or characteristics of the plurality of elongate members 100, 200, 300 and/or the spacer 50 will be discussed in further detail below with respect to the embodiments of FIGS. 5-8. Features of any of the embodiments described herein may be interchanged, combined, added, or absent to create additional embodiments without departing from the scope of this disclosure.

In the first embodiment, column 10 and the method of manufacturing column 10 may include the spacer 50 being inserted between the plurality of elongate members 100, 200, 300, and the arrangement being fastened together with the fastening elements 99 (FIG. 1). For example, as shown in FIG. 2, the second face of the first side member 140 is arranged adjacent the first face of the center member 330, and the first face of the second side member 230 is arranged adjacent the second face of the center member 340. The first spacer portion 52 may be inserted between the second face of the first side member 140 and the first face of the center member 330. The third spacer portion 56 may be inserted between the second face of the center member 340 and the first face of the second side member 230. When the spacer 50 is inserted as described, the second spacer portion 54 may be adjacent to and/or substantially parallel to the third face 350 of the center member 300. In some embodiments, the center member 300 includes one or more center members 300. In some embodiments, the spacer 50 includes one or more spacers 50. Once arranged, the first side member 100, the second side member 200, the center member(s) 300, and the spacer (s) 50 are joined together with the fastening elements 99 (FIG. 1).

As shown in the side view of FIG. 4, this construction including spacer 50 advantageously increases a slot width 94 of the slot 92 between the first side member 100 and the second side member 200 by creating gaps 90 between the plurality of elongate members 100. The slot 92 is formed by the bounds of the second face of the first side member 140, the first face of the second side member 230, and the first end(s) of the center member 310. The previously described slot length 96 defined along the length axis 12.

In the arrangement of the spacer 50 in FIGS. 1-4, the second spacer portion 54 may be arranged adjacent to and substantially parallel to the third face of the center member 350. In some embodiments, all or a portion of the spacer 50 is adhered to the center member(s) 300 to retain the spacer 50 during manufacturing and facilitate an easier assembly process.

In one or more embodiments, a portion of the spacer 50 is removed after the plurality of elongate members 100, 200, 300 and the spacer 50 are joined together. For example, the second spacer portion 54 may be removed, such as by planing along one or more of the third faces 150, 250, 350 of the plurality of elongate members 100, 200, 300. The planing operation may result in two or more of the third faces 150, 250, 350 being made flush with one another. This may be done for cosmetic reasons, or to provide a smoother or flatter exterior surface. In some embodiments, one or more of the fourth faces 160, 260, 360 may be similarly removed.

One embodiment where removal of the fourth faces 160, 260, 360 may be beneficial is an embodiment where the spacer 50 has a fourth spacer portion (not shown) that is connected to the first and third spacer portions 52, 56 opposite the second spacer portion 54, forming a continuous rectangular walled construction. Such a spacer construction could be slid over the first end of the center member 310, or the second end of the center member 320. This construction may provide retention of the spacer 50 during the arrangement and joining steps during manufacturing.

While the plurality of elongate members 100, 200, 300 may need to carry a load along the length axis 12, the spacer 50 may not need to provide any significant structural integrity, or even resistance to water or other aspects of the environment. Therefore, the spacer 50 may be formed from a wide variety of materials including cardboard, plastic, foam, recycled materials, fiberboard, wood, a sheet or roll of adhesive material, or a combination or composite of such materials. Any other suitable material may also be used.

In addition to the first embodiment described above with respect to FIGS. 1-4, other embodiments will now be described. For the sake of brevity, like numerals will be used to describe like elements (e.g., 50', 50" may include all the features of 50; 100', 100" may include all the features of 100, etc.). For example, the features of the first side member 100, the second side member 200, the center member 300 described above, including all of the relevant ends and faces of the plurality of members 110, 120, 130, 140, 150, 160, 210, 220, 230, 240, 250, 260, 310, 320, 330, 340, 350, 360), the spacer 50, the slot 92, the slot width 94, the slot length 96, and the gaps 90 described above will not be described in full detail in the following embodiments, but rather may include any of the characteristics previously disclosed.

Figure 5:
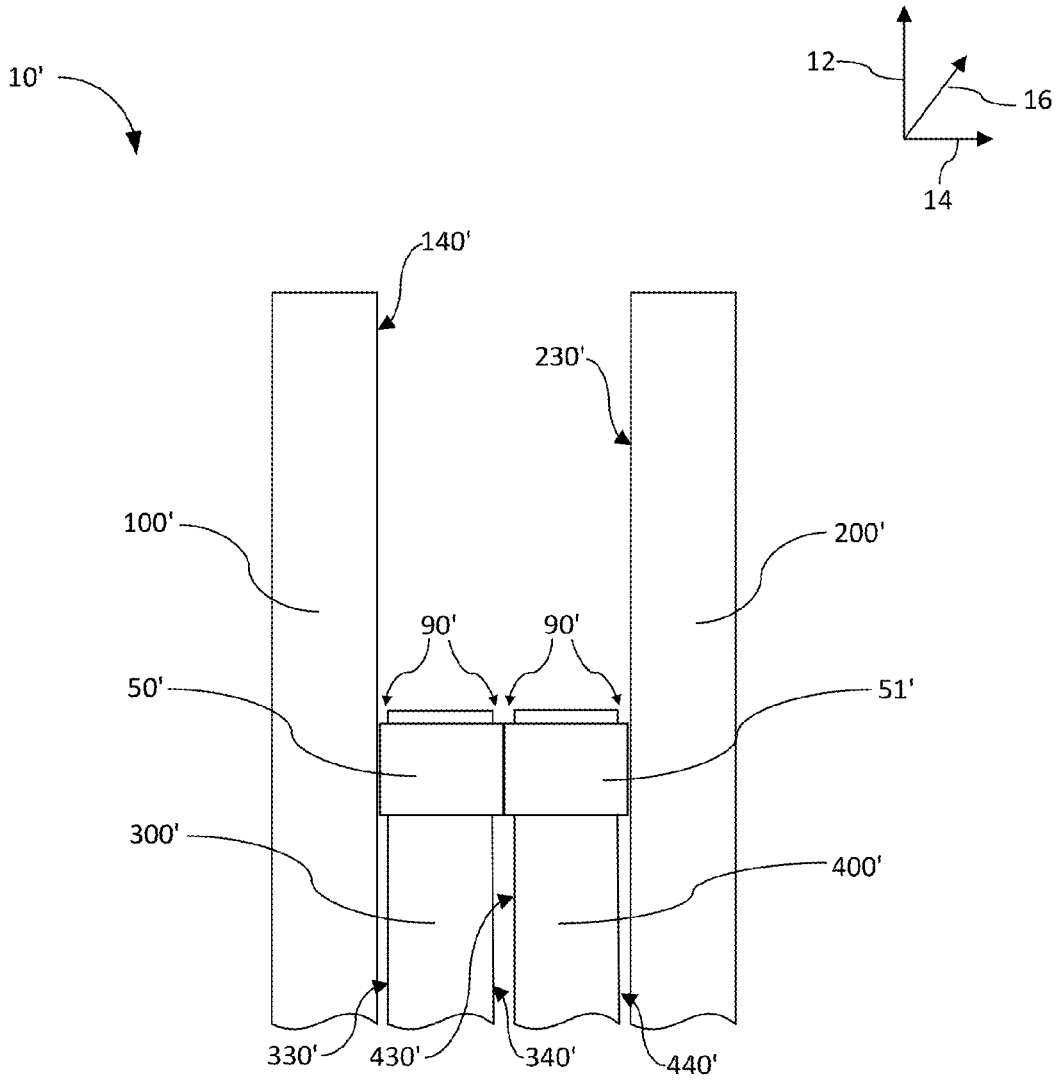
FIG. 5 is a side view of a second embodiment of a column.

FIG. 5 shows a side view of a second embodiment of a column 10' formed from a plurality of elongate members 100', 200', 300', 400' and one or more spacers 50', 51'. The plurality of elongate members 100', 200', 300', 400' may include a first side member 100', a second side member 200', a first center member 300', and a second center member 400', the first spacer 50' and the second spacer 51'.

The first and second spacers 50', 51' may be made of the same materials and/or dimensions as spacer 50 of FIGS. 1-4. However, in some embodiments the two spacers 50, 51' may be different materials and/or dimensions depending on the application. Both spacers 50 may have a first spacer portion 52, a second spacer portion 54 and a third spacer portion 56 as previously described with respect to FIGS. 3*a*-3*b*.

Placement of the two spacers 50', 51' may include inserting a first spacer portion 52 (FIGS. 3*a*-3*b*) of the first spacer 50' between a second face of the first side member 140' and a first face of the first center member 330', and placing a third spacer portion 54 (FIGS. 3*a*-3*b*) of the spacer 50' between a second face of the first center member 340' and a first face of the second center member 430'. Insertion of the second spacer 51' may include inserting a first spacer portion 52 (FIGS. 3*a*-3*b*) of the second spacer 51' between the second face of the first center member 340' and the first face of the second center member 430', and inserting a third spacer portion 54 (FIGS. 3*a*-3*b*) of the second spacer 51' between the second face of the second center member 440' and the first face of the second side member 230'.

Figure 6:
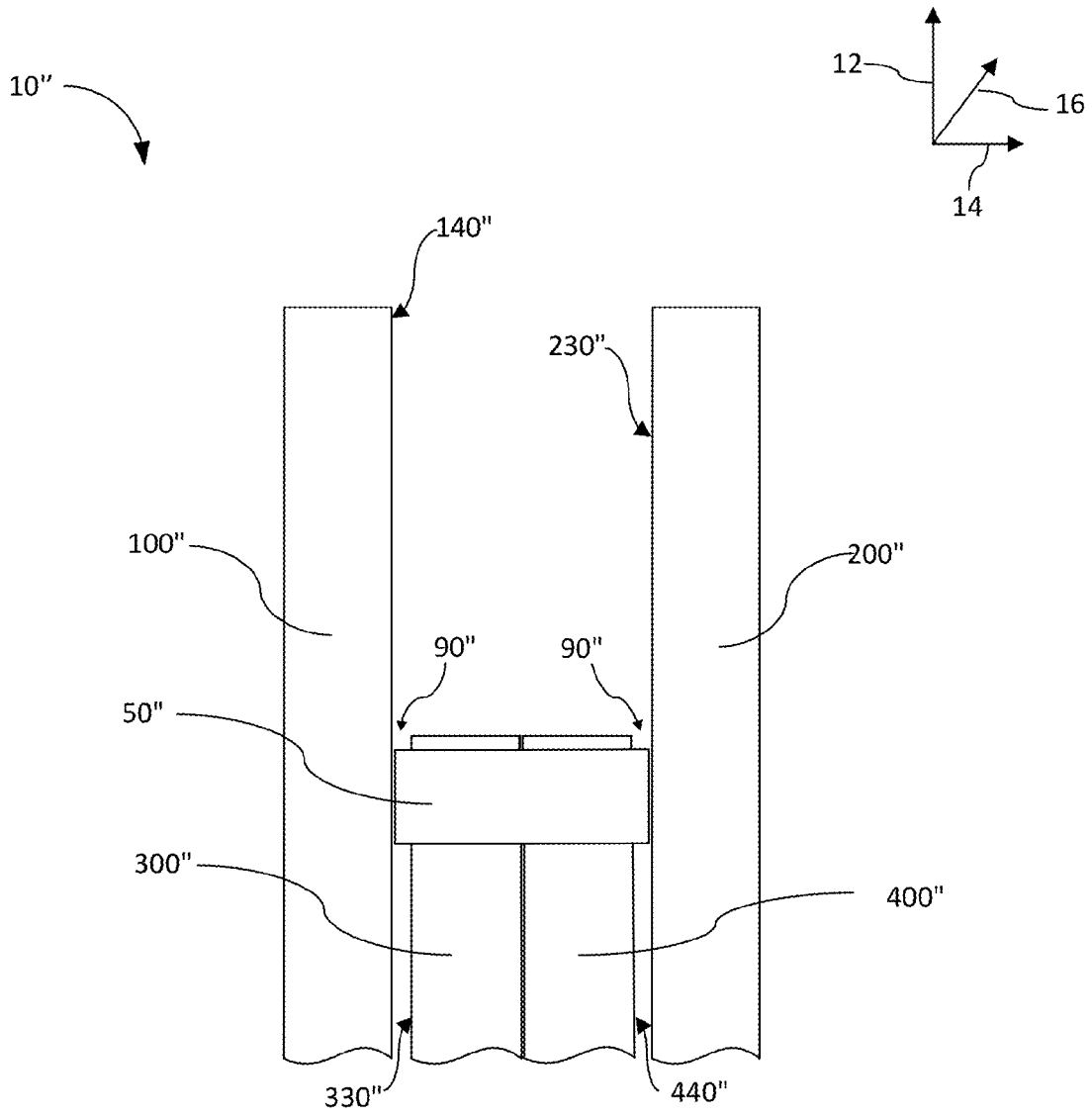
FIG. 6 is a side view of a third embodiment of a column.

FIG. 6 shows a side view of a third embodiment of a column 10" formed from a plurality of elongate members 100", 200", 300", 400" and a spacer 50". The spacer 50" may be of increased width as compared to the spacer 50' of the second embodiment (FIG. 5). Like the embodiment of FIG. 5, the embodiment of FIG. 6 may include more than one center member 300. For example, the embodiment of FIG. 6 may include a first center member 300" and a second center member 400" similar to the embodiment of FIG. 5. However, in contrast to the embodiment of FIG. 5 which has two spacers 50', 51', the embodiment of FIG. 6 may include only one spacer 50". Therefore, the spacer 50" may be formed with an increased spacer thickness 58 (FIG. 3*b*). In some embodiments, the spacer 50" may be twice as thick as spacer 50' so that it provides the same total gap 90" as the gap 90' created by spacers 50' and 51' of FIG. 5.

As shown in FIG. 6, insertion of the spacer 50" may include inserting a first spacer portion 52 (FIGS. 3*a*-3*b*) of the spacer 50" between the second face of the first side member 140" and the first face of the first center member 330". Insertion of the spacer 50" may further include inserting the third spacer portion 56 (FIGS. 3*a*-3*b*) of the spacer 50 between the second face of the second center member 440" and the first face of the second side member 230". As shown in FIG. 6, the second spacer portion 54 (FIGS. 3*a*-3*b*) of the spacer 50" may span across both of the center members 300", 400".

Figure 7:
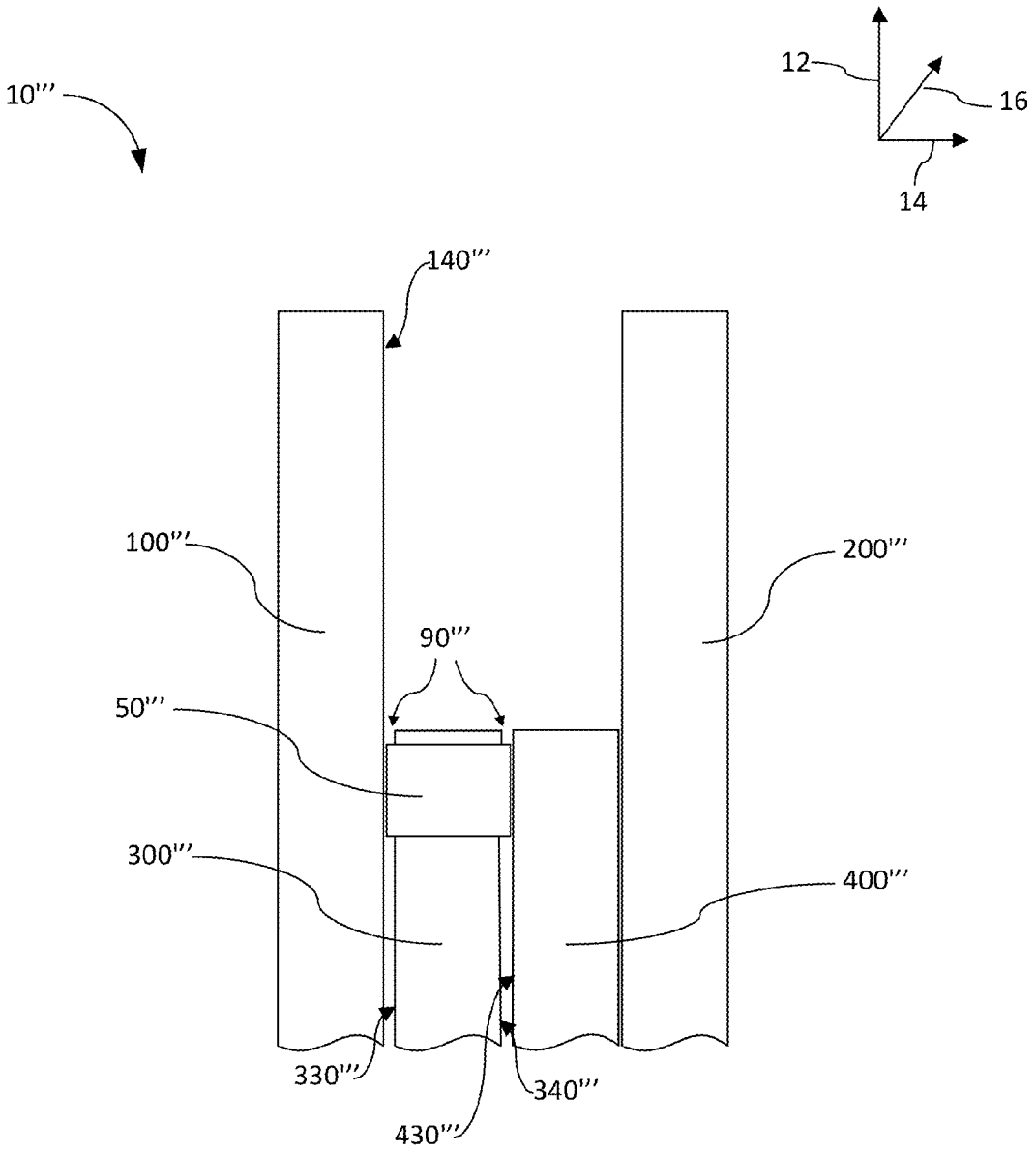
FIG. 7 is a side view of a fourth embodiment of a column.

FIG. 7 shows a side view of a fourth embodiment of a column 10'" formed from a plurality of elongate members 100'", 200'", 300'", 400' and a spacer 50'". The fourth embodiment may include aspects of the second and third embodiments including a first side member 100'", a second side member 200'", a first center member 300'", and a second center member 400'". The spacer 50" shown in FIG. 7 may be of increased spacer thickness (58, FIG. 3*b*) as compared to the second embodiment shown in FIG. 5, and it may be the same or similar to the thickness of the spacer 50" of the third embodiment shown in FIG. 6. In some embodiments, the spacer 50" may be twice as thick as spacer 50' so that it provides the same total gap 90'" as the gap 90' created by spacers 50' and 51' in FIG. 5.

As shown in FIG. 7, insertion of the spacer 50" may include inserting the spacer 50" between the second face of the first side member 140'" and the first face of the first center member 330'". Insertion of the spacer 50" may further include inserting a third spacer portion 50" between the second face of the first center member 340'" and the first face of the second center member 430'.

Figure 8:
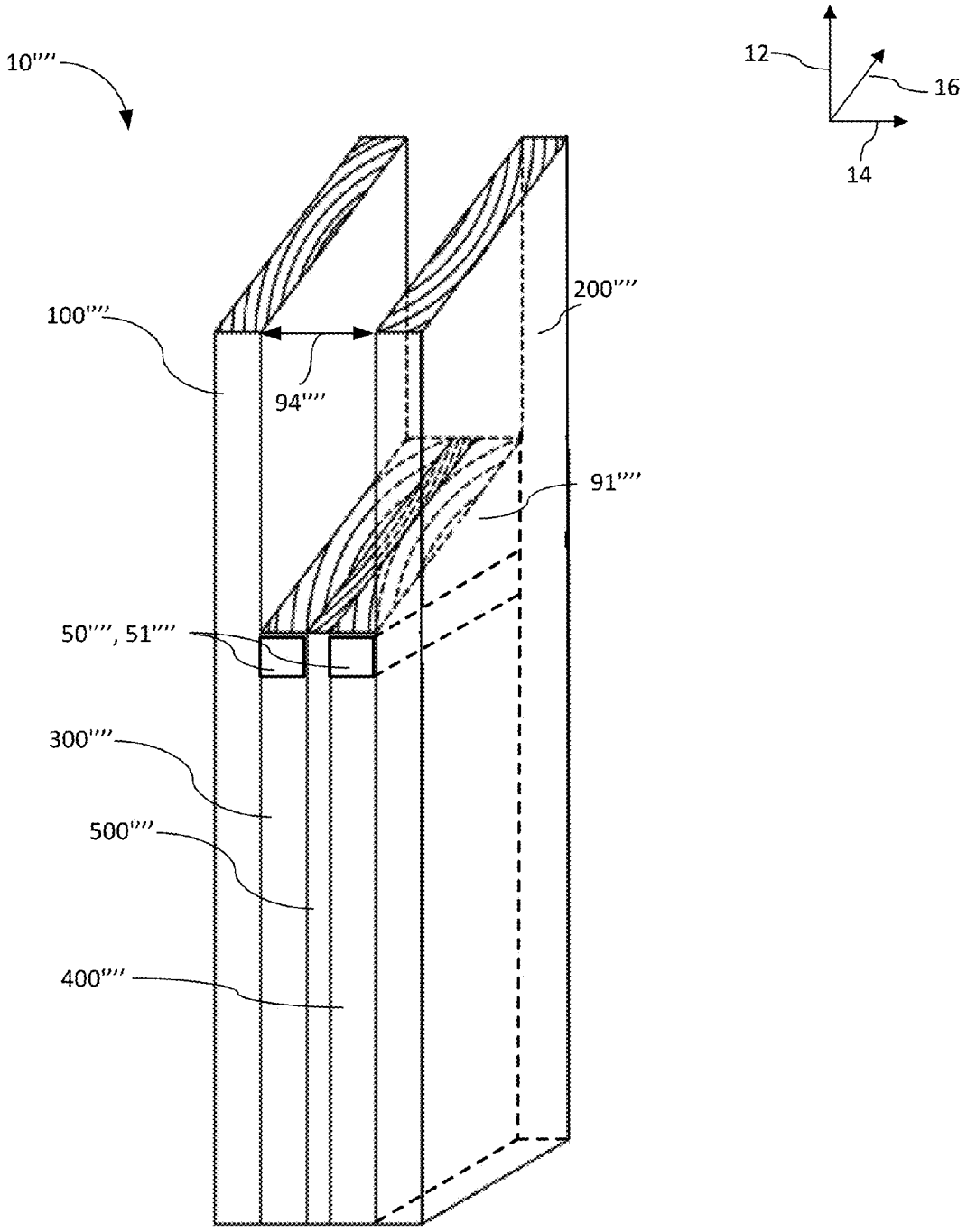
FIG. 8 is a perspective view of a fifth embodiment of a column.

FIG. 8 shows a side view of a fifth embodiment of a column 10"" formed from a plurality of elongate members 100"", 200"", 300"", 400"", 500"" and may further include spacers 50"", 51"". In some embodiments, at least one of the one or more elongate members 100"", 200"", 300"", 400"", 500"" may include a pitch 91"" at a first end of the one or more elongate members 100"", 200"", 300"", 400"", 500"". The preferred pitch 91"" may be a 4/12 pitch as shown in FIG. 8. However, a pitch 91"" in the range between a 1/12 and 12/12 pitch may be used depending on the particular application. The pitch 91"" may accommodate and provide a favorable bearing surface for a particular roof truss 11 construction.

The embodiment of FIG. 8 shows a third center member 500"" which may be of a different or the same dimensions as the other center members 300"", 400"". For example, in some embodiments, the first and second side members 100"", 200"", and first and second center members 300"", 400"" could be formed of 2×4's, 2×6's, 2×8's, 2×10's or 2×12's, while the third center member 500"" could be formed of a 1×4, 1×6, 1×8, 1×10 or 1×12. In such an embodiment, the preferred slot width 94"" may be about 3.75 inches. In some embodiments, the preferred slot width 94"" may be in the range of about 3.50" to 4.00".

Figure 9:
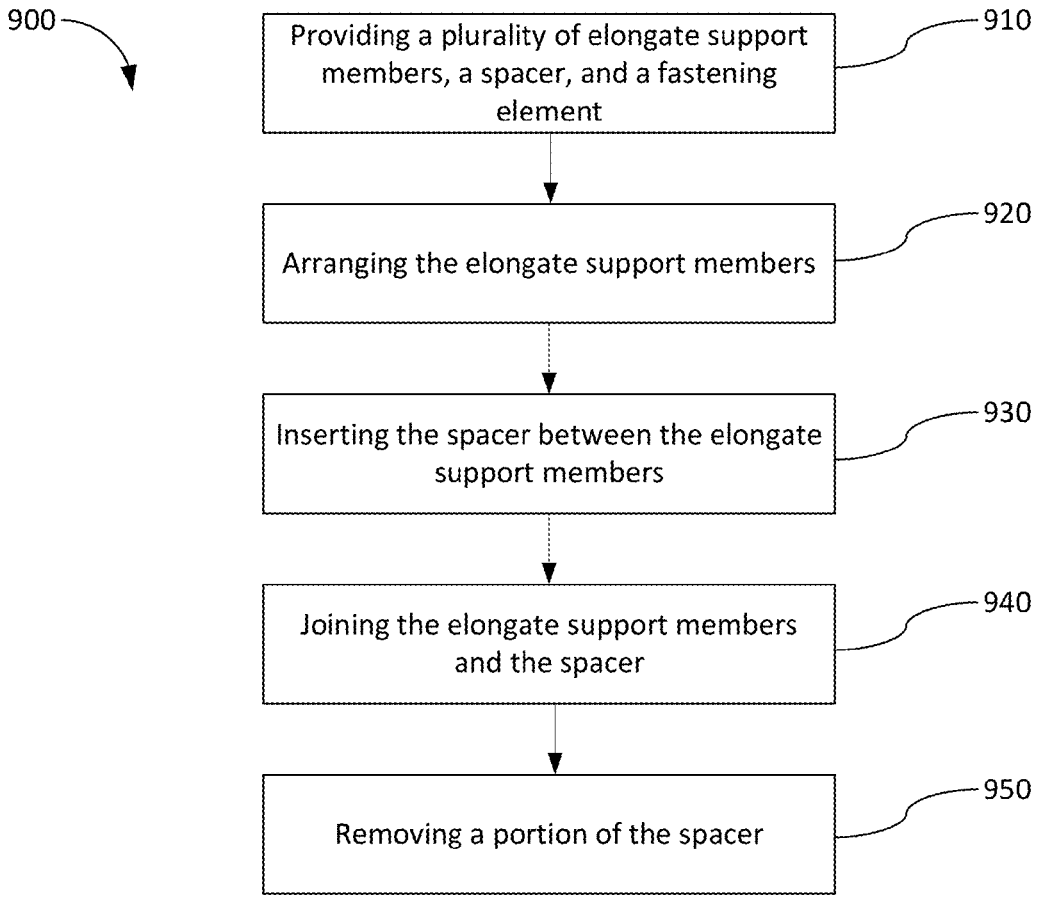
FIG. 9 is a flow chart illustrating an embodiment of a method of manufacturing a column for a post frame building.

FIG. 9 is a flow chart illustrating an example method 900 of manufacturing a column for a post frame building. Such method 900 may be used with, but is not limited to, the columns 10, 10', 10", 10'", 10"" described above. With reference to FIGS. 1-8. The method 900 may include: providing a plurality of elongate support members, a spacer 50 and a fastening element (step 910); arranging the plurality of elongate support members side-by side (step 920); inserting the spacer 50 between the elongate support members (step 930); and joining the elongate support members and the spacer 50 together with a fixation element (step 940). In some embodiments, the method 900 may optionally include removing a portion of the spacer 50 (step 950). Step 950, including removing a portion of the spacer 50, may also include removing a portion of one or more of the plurality of elongate support members. The optional removing or planing process was previously described with reference to the first embodiment of FIGS. 1-4.

Illustrative embodiments of laminated column constructions and methods of manufacturing such laminated column constructions have been set forth, and reference has been made to possible variations. These and other variations and modifications of the invention will be apparent to those skilled in the art without departing from the scope of the invention, and it should be understood that this invention is not limited to the illustrative embodiments set forth herein.

The invention claimed is:

1. A method of manufacturing a column for a post frame building, the method comprising:

providing lumber, the lumber comprising a plurality of elongate members that are substantially rectangular cuboid shaped, arranged side-by-side, each elongate member comprising:

a first end opposite a second end, the distance between the first and second ends defining a length of each elongate member;

a first face opposite a second face, the distance between the first and second faces defining a width of each elongate member;

a third face opposite a fourth face, the distance between the third and fourth faces defining a depth of each elongate member;

wherein the plurality of elongate members comprise a first side member, one or more center members, and a second side member;

providing a first spacer formed by a first spacer portion, a second spacer portion and a third spacer portion, the second spacer portion connecting the first spacer portion and the third spacer portion;

providing a fastening element;

arranging the second face of the first side member adjacent the first face of one of the one or more center members, and arranging the first face of the second side member adjacent the second face of one of the one or more center members;

inserting the first spacer portion between the second face of the first side member and the first face of one of the one or more center members at a location closer to the first end of the one or more center members than the second end of the one or more center members;

inserting the third spacer portion between the second face of the one of the one or more center members and the first face of the second side member at a location closer to the first end of the one or more center members than the second end of the one or more center members; and joining the first side member, the one or more center members, and the second side member together with the fastening element.

2. The method of claim 1, wherein the first ends of the one or more center members and/or the first and second side members are angled non-perpendicular with respect to the third and fourth faces of the respective one or more center members and/or the first and second side members such that the first ends comprise a pitch in a range between a 1/12 pitch and 12/12 pitch.

3. The method of claim 2, further comprising removing at least a portion of the second spacer portion.

4. The method of claim 3, wherein inserting the second spacer portion further comprises arranging the second spacer portion adjacent and substantially parallel to the third face of one of the one or more center members.

5. The method of claim 4, wherein the second spacer portion is coupled to the first spacer portion at a first hinge, and the second spacer portion is coupled to the third spacer portion at a second hinge, wherein the first hinge and the second hinge are spaced apart from one another and are configured to be bent at approximately 90 degree angles.

6. The method of claim 1, further comprising removing at least a portion of the third or fourth face of at least one of the plurality of elongate members.

7. The method of claim 1, wherein the thickness of the spacer is between 0.020 inches to 0.100 inches.

8. The method of claim 1, wherein the spacer comprises cardboard, plastic, foam, recycled materials, fiberboard, wood, a sheet of adhesive material, or a combination or composite thereof.

9. The method of claim 1, wherein providing the plurality of elongate members comprises providing 2×4, 2×6, 2×8, 2×10 or 2×12 wood lumber.

10. The method of claim 1, wherein the length of one of the one or more center members is between 3 inches to 6 feet shorter than the length of the first and second side members.

11. The method of claim 1, wherein the one or more center members comprise first and second center members each formed from a 2×4, 2×6, 2×8, 2×10 or 2×12, and a third center member formed from a 1×4, 1×6, 1×8, 1×10 or 1×12, such that a slot is formed by the bounds of the second face of the first side member, the first face of the second side member and the first ends of the one or more center members, the slot having a width of about 3.75 inches.

12. The method of claim 1, wherein the providing the one or more center members comprises providing a first center member and a second center member, and wherein the inserting the first spacer comprises inserting the first spacer portion of the first spacer between the second face of the first side member and the first face of the first center member, and the inserting the third spacer portion of the first spacer between the second face of the first center member and the first face of the second center member, and providing a second spacer formed by a first spacer portion, a second spacer portion and a third spacer portion, the second spacer portion connecting the first spacer portion and the third spacer portion inserting the first spacer portion of the second spacer between the second face of the first center member and the first face of the second center member, and inserting the second spacer portion of the second spacer between the second face of the second center member and the first face of the second side member.

13. The method of claim 1, wherein the one or more center members comprises a first center member and a second center member, and wherein the inserting the spacer comprises inserting the first spacer portion between the second face of the first side member and the first face of the first center member, and inserting the third spacer portion between the second face of the second center member and the first face of the second side member.

14. The method of claim 1, wherein the one or more center members comprises a first center member and a second center member, and wherein the inserting the spacer comprises inserting the first spacer portion comprises inserting the first spacer portion between the second face of the first side member and the first face of the first center member, and inserting the third spacer portion between the second face of the first center member and the first face of the second center member.

15. A method of manufacturing a column for a post frame building, the method comprising:

providing lumber, the lumber comprising a plurality of elongate members that are substantially rectangular cuboid shaped, each elongate member comprising:

a first end opposite a second end, the distance between the first and second ends defining a length of each elongate member;

a first face opposite a second face, the distance between the first and second faces defining a width of each elongate member;

a third face opposite a fourth face, the distance between the third and fourth faces defining a depth of each elongate member;

wherein the plurality of elongate members comprise a first side member, one or more center members, and a second side member;

providing a spacer formed by a first spacer portion, a second spacer portion and a third spacer portion, the second spacer portion connecting the first spacer portion and the third spacer portion, the first and third spacer portions being generally parallel, the second spacer portion being at about a 90 degree angle to the first and third spacer portions;

arranging the second face of the first side member adjacent the first face of one of the one or more center members, and arranging the first face of the second side member adjacent the second face of one of the one or more center members;

inserting the first spacer portion between the second face of the first side member and the first face of one of the one or more center members at a location closer to the first end of the one or more center members than the second end of the one or more center members;

inserting the third spacer portion between the second face of the one of the one or more center members and the first face of the second side member at a location closer to the first end of the one or more center members than the second end of the one or more center members;

placing the second spacer portion substantially parallel to the third face of the one of the one or more center members;

providing a fastening element; and joining the first side member, the one or more center members, the second side member and the spacer together with the fastening element.

16. The method of claim 15, further comprising removing the second spacer portion.

17. The method of claim 16, wherein the removing the second spacer portion includes planing the third faces of the one of the one or more center members and the third face of the first side member until flush, thereby removing the second spacer portion.

18. A laminated column for constructing a post frame building, the column comprising:

a spacer having a first spacer portion and one or more other spacer portions;

a fastening element;

a plurality of elongate members that are formed of substantially rectangular cuboid shaped lumber, arranged side-by-side, each elongate member comprising:

a first end opposite a second end, the distance between the first and second ends defining a length of each elongate member;

a first face opposite a second face, the distance between the first and second faces defining a width of each elongate member;

a third face opposite a fourth face, the distance between the third and fourth faces defining a depth of each elongate member;

wherein the plurality of elongate members comprise a first side member, one or more center members, and a second side member, and wherein the length of the one or more center members is between 3 inches to 6 feet shorter than the first and second side members, wherein the first spacer portion is sandwiched between the second face of the first side member and the first face of one of the one or more center members, and at least one of the one or more other spacer portions is sandwiched between a second face of one of the one or more center members and the first face of the second side member, wherein the plurality of elongate members and the spacer are fixedly joined by the fastening element, and wherein the spacer is located closer to the first end of the one or more center members than the second end of the one or more center members.

19. The column of claim 18, wherein the spacer is bent at approximately 90 degree angles in two spaced apart locations.

20. The column of claim 18, wherein a spacer height is defined as the dimension of the spacer along the length of the one or more center members, and wherein the spacer height is less than the length of at least one of the one or more center members.

* * * * *